US006185949B1

(12) United States Patent
Madigan

(10) Patent No.: US 6,185,949 B1
(45) **Date of Patent: *Feb. 13, 2001**

(54) DIGITAL CONTROL VALVE FOR REFRIGERATION SYSTEM

(75) Inventor: Mark P. Madigan, Lodi, WI (US)

(73) Assignee: Mad Tech, L.L.C., Lodi, WI (US)

( * ) Notice: Under 35 U.S.C. 154(b), the term of this patent shall be extended for 0 days.

This patent is subject to a terminal disclaimer.

(21) Appl. No.: 09/235,773

(22) Filed: Jan. 22, 1999

Related U.S. Application Data

(63) Continuation-in-part of application No. 08/929,961, filed on Sep. 15, 1997, now Pat. No. 5,873,255.

(51) Int. Cl.[7] ..... F25B 45/00; F25B 41/04
(52) U.S. Cl. ..... 62/222; 62/77
(58) Field of Search ..... 62/511, 505, 222, 62/77

(56) References Cited

U.S. PATENT DOCUMENTS

| | | | |
|---|---|---|---|
| 4,258,553 | 3/1981 | Kelly et al. | 62/117 |
| 4,974,427 | 12/1990 | Diab | 62/505 |
| 5,076,067 | 12/1991 | Prenger et al. | 62/197 |
| 5,189,883 | 3/1993 | Bradford | 62/83 |
| 5,329,788 | 7/1994 | Caillat et al. | 62/505 |
| 5,640,854 | 6/1997 | Fogt et al. | 62/197 |

*Primary Examiner*—William Wayner
(74) *Attorney, Agent, or Firm*—Michael Best & Friedrich LLP

(57) ABSTRACT

The present invention provides a method and system for controlling and limiting the discharge temperature of a compressor of a refrigeration system. The invention is suitable for converting an existing refrigeration system which operates with one refrigerant to use with another refrigerant which can cause high discharge temperatures. The invention includes a simple four-part system—a temperature sensor to sense the discharge temperature, an injection valve for injecting liquid refrigerant into the suction gas line of the compressor, a fluid line for providing liquid refrigerant to the valve from the condenser and a digital controller for actuating the valve.

18 Claims, 5 Drawing Sheets

DIGITAL CONTROL VALVE FOR REFRIGERATION SYSTEM

CROSS-REFERENCE TO RELATED APPLICATIONS

This application is a continuation in part of U.S. Ser. No. 08/929,961, now U.S. Pat. No. 5,873,255 filed Sep. 15, 1997.

STATEMENT REGARDING FEDERALLY SPONSORED RESEARCH PR DEVELOPMENT

Not applicable.

BACKGROUND OF THE INVENTION

This invention relates generally to refrigeration systems and in particular, to a method for preventing overheating of the compressor of a refrigeration system, including those systems utilizing scroll type compressors. The invention is particularly well-suited for converting an existing refrigeration system using one refrigerant having particular physical and thermodynamic properties to use with another refrigerant having significantly different properties.

The design specifications of a refrigeration system are generally predicated on the choice of specific refrigerant to be utilized, i.e., on its physical and thermodynamic properties. For years, chlorofluorocarbons, e.g., CFC-12 or R-12; CFC-502 or R-502, had been used in compression refrigeration systems. These chlorofluorocarbons have excellent stability and were well suited for low temperature applications.

During the past two decades, it has been found that such chlorofluorocarbons released into the earth's atmosphere were depleting the ozone layer. Reduction in the ozone layer has been linked to many effects such as an increased risk for skin cancer. In response to concerns over ozone layer depletion, the U.S. government has imposed increasingly stricter limitations on the use of these refrigerants. These limitations require the phase out of the commonly used refrigerants with other refrigerants considered not so effect the ozone layer.

Currently, many commercial refrigeration systems utilize R-502 and the design features of such systems are dictated by the properties of R-502, e.g., type, size and operating parameters of the compressor. The phase out of R-502 in favor of other refrigerants, such as R-22 or AZ-50, is not a simple matter of removing the refrigerant from the existing system and replacing it with the environmentally preferred refrigerant. The physical and thermodynamic properties of, e.g., R-22, refrigerant are significantly different from those of R-502 such that the refrigeration system operates with different performance parameters than those required by R-502.

In the normal compression refrigeration cycle, vapor refrigerant is drawn into a compressor where it is compressed to a higher pressure. The compressed vapor refrigerant is cooled and condensed in a condenser into a high pressure liquid which is then expanded, typically through an expansion valve, to a lower pressure and caused to evaporate in an evaporator to thereby draw heat and thus, provide the desired cooling effect. The expanded, relatively low pressure vapor refrigerant exiting the evaporator is once again drawn into the compressor and the cycle starts anew.

A variety of compressor types have been used in refrigeration systems, including reciprocating compressors, screw compressors, rotary compressors and scroll compressors.

Scroll compressors are becoming increasingly popular due to their capability for extremely high operating efficiency as compared to reciprocating, screw and rotary compressors. Scroll compressors are constructed using two scroll members with each scroll member having an end plate and a spiral wrap. The spiral wraps are arranged in an opposing manner with the two spiral wraps being interfitted. The scroll members are mounted so that they may engage in relative orbiting motion with respect to each other. During this orbiting movement, the spiral wraps define a successive series of enclosed spaces, each of which progressively decreases in size as it moves inwardly from a radially outer position at a relatively low suction pressure to a central position at a relatively high pressure. The compressed gas exits from the enclosed space at the central position through a discharge passage formed through the end plate of one of the scroll members.

A problem that all compressors, including scroll compressors, have in common is the need to avoid excessive heating of the compressor during high load operation. The action of compressing the vapor refrigerant imparts work onto the vapor and results in a significant increase in the vapor temperature. While a substantial portion of this heat is subsequently transferred to the atmosphere during the condensation process, a portion of the heat is transferred to the compressor components. Depending upon the specific refrigerant vapor compressed and on the pressure conditions operation, this heat transfer can cause the temperature of the compressor components to overheat, resulting in degradation of compressor performance, of the compressor lubricant or oil, and potentially damage to the compressor itself. For example, it has been found that the direct substitution of R-22 for R-502 in an existing refrigeration system results in high discharge temperatures, particularly under high load situations and high compression ratios.

One solution for converting existing systems using R-502 to R-22 or other substitutes calls for the replacement of expensive equipment, e.g., the compressor or supplementation of the existing condenser, resulting in significant capital costs as well as higher operating costs due to increase capacity needed for the compressor and condenser. Some prior art systems have attempted to respond to this problem. See, e.g., U.S. Pat. No. 5,189,883 issued to Bradford which discloses a refrigeration retrofit system utilizing a liquid refrigerant injection system, and U.S. Pat. No. 5,640,854 issued to Fogt et al., U.S. Pat. No. 5,329,788 issued to Caillat et al., U.S. Pat. No. 5,076,067 issued to Prenger et al. and U.S. Pat. No. 4,974,427 issued to Diab which also disclose a liquid refrigerant injection system for limiting or controlling excessive discharge gas temperature. These prior art systems, however, require the installation of multiple components to an existing system, require significant structural modification to an existing system or do not permit at all modification to an existing system.

Despite recognition and study of various aspects of the replacement refrigerant problem, the prior art has still not produced a simple, economical way to prevent overheating especially in converting existing refrigeration and air conditioning systems designed, e.g., for R-502, to the use of newer, environmentally preferred refrigerants.

BRIEF SUMMARY OF THE INVENTION

The present invention provides a simple economical method and system for controlling and limiting the discharge temperature of a compressor of a refrigeration system arising from all variety of reasons. The invention is particularly suitable for converting an existing refrigeration system which operates with one refrigerant having specific physical and thermodynamic properties to use with another refrigerant with different properties which can cause high discharge temperatures. The invention includes a simple four-part system—a temperature sensor to sense the discharge temperature of the gaseous refrigerant from the compressor, an injection valve for injecting liquid refrigerant into the suction gas line of the compressor, a fluid line for providing liquid refrigerant to the valve from the condenser and a digital controller for actuating the valve.

The foregoing, and other advantages of the present invention, are realized in one aspect thereof in a liquid refrigerant injection system for controlling discharge gas temperature in a refrigeration system which has a compressor having a discharge line for discharging compressed refrigerant and a suction line for admitting gaseous refrigerant into the compressor; a condenser with a liquid refrigerant outlet; and an evaporator, each connected in a closed loop with the compressor. The injection system in accordance with the present invention includes a temperature sensor for sensing the temperature of compressed gaseous refrigerant; a fluid line connecting the outlet of the condenser to the suction line of the compressor for conducting a liquid refrigerant fluid flow to the compressor; a solenoid injection valve, operatively associated with the fluid line, for injecting liquid refrigerant into the suction line of the compressor; and a controller for selectively actuating the valve. The temperature sensor is suitably disposed within the discharge chamber of the head of the compressor of piston-type compressors. In the case of scroll type compressors, the temperature sensor is suitably disposed in or adjacent the discharge line.

The temperature sensor transmits the sensed temperature as temperature signals to the controller. The controller is electronically coupled to the temperature sensor, and receives the transmitted temperature signals. The controller compares the transmitted temperature signals to a preselected temperature, and develops valve actuating signals for actuating the injection valve. The injection valve is operatively associated with the controller and is in communication with the fluid line. The injection valve is responsive to the valve actuating signals, and controls fluid flow into the suction line.

In another aspect, the invention is a method for controlling high discharge gas temperature in a compressor of a refrigeration system, which includes the steps of: sending the temperature of the discharge gas from the compressor to a controller; providing a fluid line from the condenser for conducting liquid refrigerant to the suction line of the compressor; attaching an injection valve to the fluid line for controlling liquid refrigerant fluid flow into the suction line; and operatively associating the controller with the injection valve to control the amount of liquid refrigerant injected into the suction line, based on the temperature of the discharge gas of the compressor.

In yet another aspect, the invention is a method for retrofitting a refrigeration system to use a different refrigerant than a current refrigerant, the new refrigerant having high gas discharge temperature. The method includes the steps of: removing the current refrigerant from the refrigeration system; providing a temperature sensor for sensing the temperature of the discharge gas; providing a fluid line from the condenser for conducting liquid refrigerant to the suction line of the compressor; attaching an injection valve to the fluid line for controlling liquid refrigerant fluid flow into the suction line; operatively associating a controller with the injection valve to control the amount of liquid refrigerant injected into the suction line based on the temperature of the discharge gas from the compressor; and recharging the system with a new refrigerant.

In still a further aspect, the invention is a kit for retrofitting a refrigeration system to use a refrigerant with a high gas discharge temperature. The kit includes a temperature sensor for sensing the temperature of the discharge gaseous refrigerant from the compressor of the system; an injection valve for controlling injection of liquid refrigerant into the suction line of the compressor; a set of fluid injection pills having various orifice sizes for attaching to the valve for adjusting orifice size; and a controller for selectively actuating said valve.

Other advantages and a fuller appreciation of the specific attributes of this invention will be gained upon an examination of the following drawings, detailed description of preferred embodiments, and appended claims. It is expressly understood that the drawings are for the purpose of illustration and description only, and are not intended as a definition of the limits of the invention.

BRIEF DESCRIPTION OF THE DRAWING(S)

The preferred exemplary embodiment of the present invention will hereinafter be described in conjunction with the appended drawing wherein like designations refer to like elements throughout and in which.

DETAILED DESCRIPTION OF THE INVENTION

The present invention relates to compression refrigeration and air conditioning systems, and particularly, to a liquid refrigerant injection method and system for limiting or controlling excessive discharge gas temperatures which can be detrimental to the compressor of the system. The method of the present invention is most particularly adapted for use in controlling discharge gas temperatures in systems which must be converted to a new, environmentally preferred refrigerant. Accordingly, the present invention will now be described in detail with respect to such endeavors; however, those skilled in the art will appreciate that such a description of the invention is meant to be exemplary only and should not be viewed as limitative on the full scope thereof.

The present invention provides a simple, economical four-part system for controlling the discharge temperature of a compressor of a refrigeration or air conditioning system. The system is particularly suitable for use in converting an existing refrigeration system utilizing, e.g., R-502 refrigerant, to the use of R-22 or other refrigerants, e.g., AZ50, MP-39, R401A, R401B, R402B, R403B, R406A, R408A, R409A, R404A, R407, R407B, R407C, R410A and R507, which are considered far less damaging to the atmospheric ozone, without the need to replace any major pieces of equipment, particularly the compressor. The present invention is characterized by an ability to control temperature of discharge gas, to adjust to the capacity of the compressor, to reconnect and use existing mechanical high pressure controls, all of which permit the efficient and economical use of ,e.g., R-22, R404A and AZ-50 and others in systems currently using R-502, The system according to the present invention can also be used to convert rack refrigeration systems, and is suitably used for all kind of compressors including scroll type compressors. These attributes are achieved through a novel combination of structural components and physical features.

Figure 1:
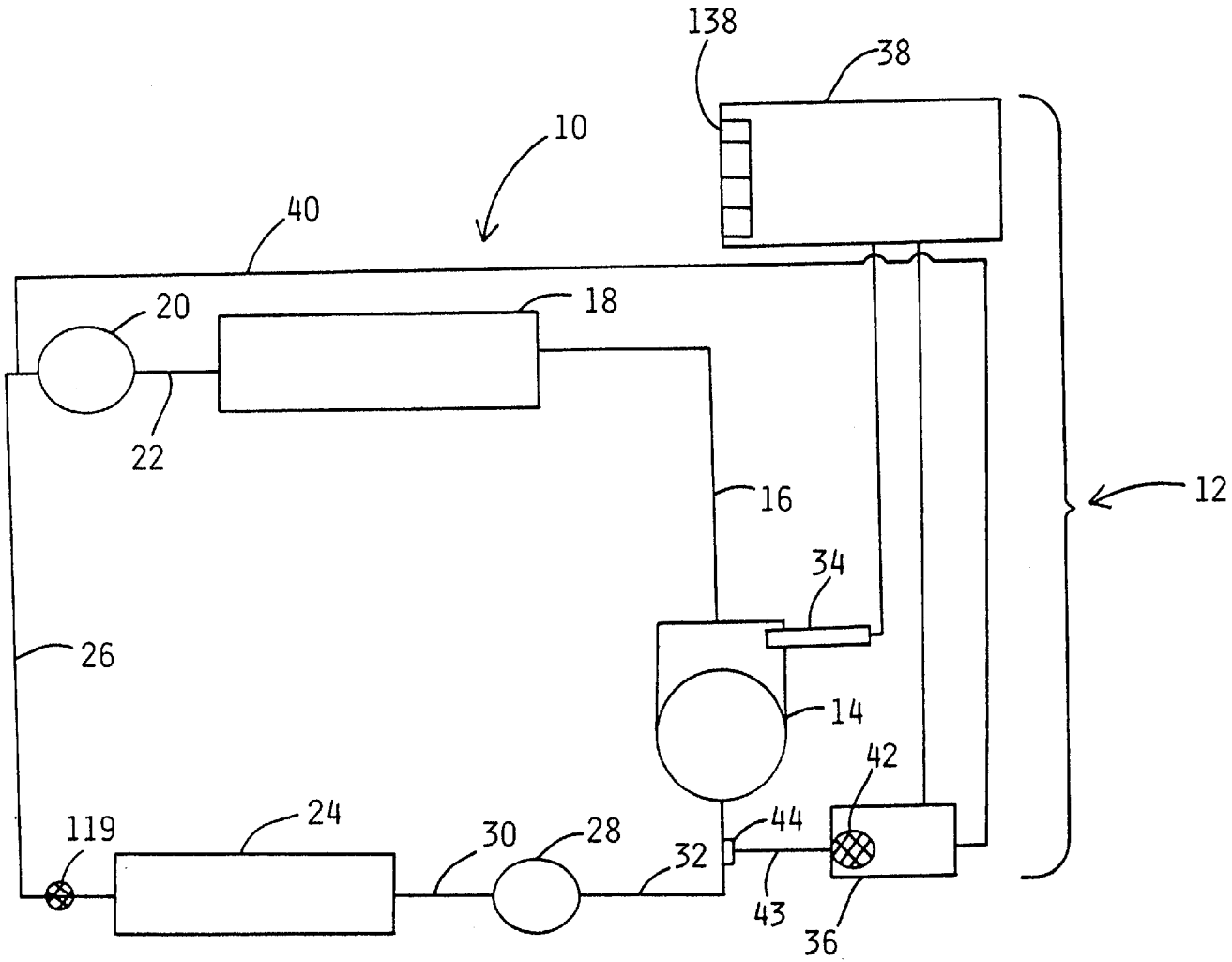
FIG. 1 is a schematic diagram of a refrigeration system incorporating the cooling liquid injection system in accordance with the present invention.

Reference is initially made to FIG. 1 depicting a typical piston-type compression refrigeration system, utilizing a refrigerant, the system generally designated as reference numeral 10, and including a liquid refrigerant injection system in accordance with the present invention, generally designated as reference number 12, is shown. Refrigeration system 10 includes a compressor 14, a condenser 18, a receiver 20 and an evaporator 24. Compressor 14 compresses refrigerant vapor, i.e., takes the refrigerant vapor at a low temperature and pressure and raises it to a higher temperature and pressure, and includes a discharge line 16 through which the higher temperature and pressure vapor is discharged into condenser 18. Condenser 18 liquefies the refrigerant which is then supplied to receiver 20 via a line 22 and into evaporator 24 via a line 26. Receiver 20 stores refrigerant when it is not needed. The output of evaporator 24 is fed to an accumulator 28 via a line 30, the output of which is connected to a suction line 32 which feeds into compressor 14.

Liquid refrigerant injection system 12 in accordance with the present invention operates to prevent overheating of compressor 14 due to excessively high discharge temperature of vapor or gaseous refrigerant. System 12 includes a temperature sensor 34, an injection valve, suitably a solenoid actuated injection valve 36, an electronic, digital, microprocessor-based controller 38 and a fluid line 40 for supplying liquid refrigerant to valve 36. Temperature sensor 34 is positioned within compressor 14 and operates to provide a signal to controller 38 which is indicative of the temperature of the compressed gas being discharged from the compressor. Fluid line 40 is connected at one end to line 26 proximate receiver 20 and at the other end to valve 36 which is operatively controlled by controller 38. The output from valve 36 is fed into a restricted orifice 42, and then through a line 43 to an injection port 44 provided in suction line 32.

Figure 2:
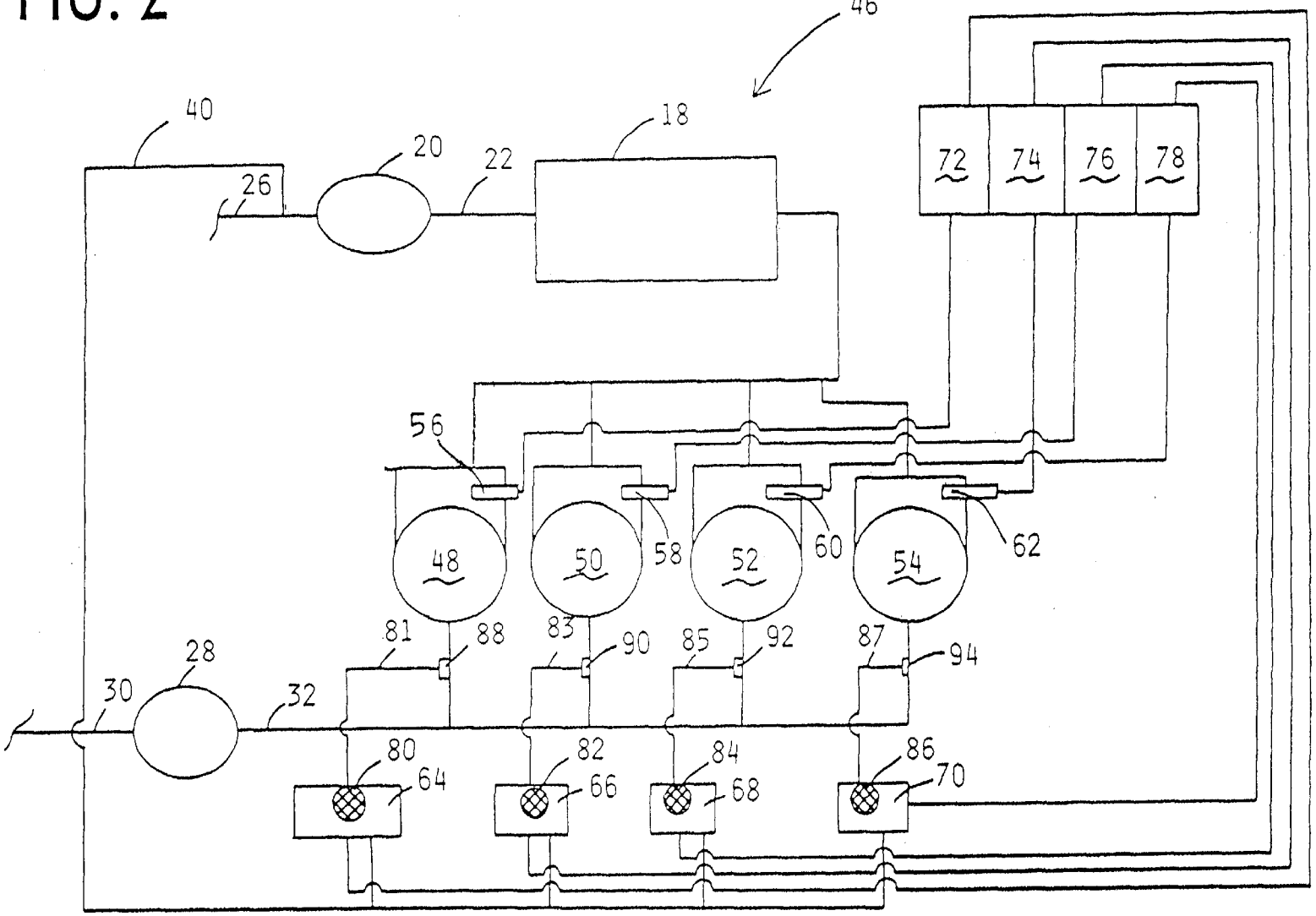
FIG. 2 is a schematic diagram of a rack refrigeration system incorporating the cooling liquid injection system in accordance with the present invention.

As best seen in FIG. 2, the present invention is also suitable for use in a rack refrigeration system 46 consisting of more than one compressor. Rack system 46 includes a plurality of compressors 48, 50, 52 and 54, respectively, connected in parallel with each other. It is noted that a rack system is not limited to any particular number of compressors. Each compressor 48, 50, 52 and 54, respectively, has provided a temperature sensor 56, 58, 60 and 62, respectively, a solenoid actuated injection valve 64, 66, 68 and 70, respectively, and an electronic digital controller 72, 74, 76 and 78, respectively, as described herein above. Temperature sensors 56, 58, 60 and 62, respectively, are positioned within compressors 48, 50, 52 and 54, respectively, and each sensor operates to provide a signal to its respective controller which is indicative of the temperature of the compressed gas being discharged from its compressor. Fluid line 40 is connected at one end to line 26 proximate receiver 20 and at the other end connected in parallel to valves 64, 66, 68 and 70, respectively, which are operatively controlled by their respective controllers, 72, 74, 76 and 78. The output from each valve is fed into a restricted orifice 80, 82, 84 and 86, respectively, and then through a line 81, 83, 85 and 87, respectively, to an injection port 88, 90, 92 and 94, respectively, provided in suction line 32 through which suction gas is admitted into each compressor.

Figure 3:
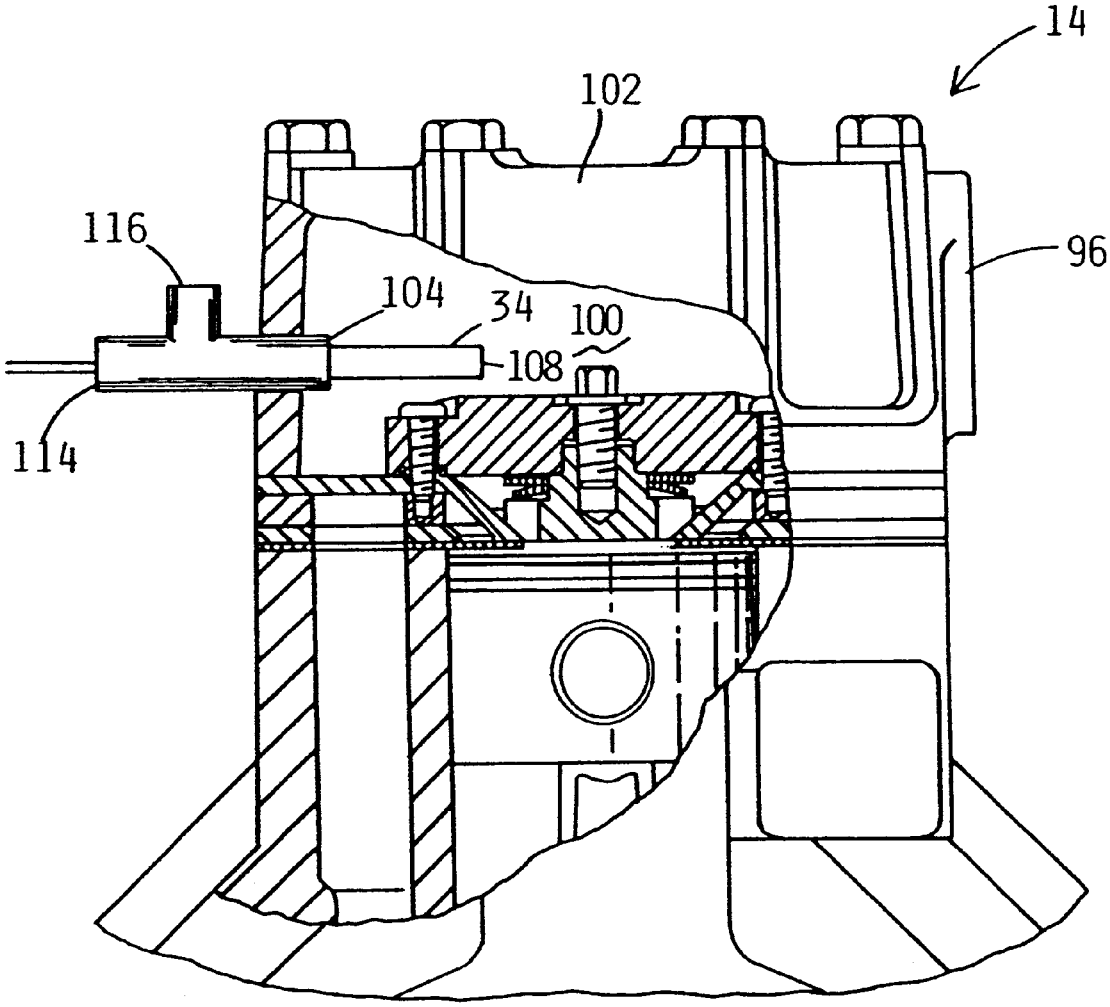
FIG. 3 is a fragmentary vertical sectional view of a compressor illustrating the incorporation of the temperature sensor in accordance with the present invention.

As best seen with reference to FIG. 3, compressor 14 (as well as compressors 48, 50, 52 and 54) includes a housing 96, a discharge chamber 100 and an overlying head 102. Suction gas is compressed typically by cylinder pistons (not shown) and eventually discharged into discharge chamber 100 defined by overlying head 102. Temperature sensor 34 is fitted within an opening 104 provided in head 102 and extends in discharge chamber 100 so as to be in direct contact with the discharge gas in the chamber. Opening 104 typically is preexisting in a compressor and through which mechanical high pressure controls (not shown) are fitted.

Figure 4:
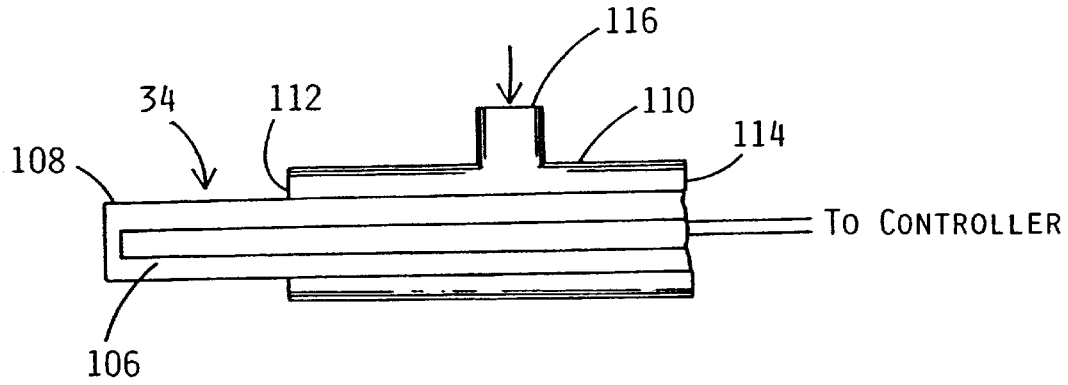
FIG. 4 is a schematic side sectional view of the temperature sensor in accordance with the present invention.

As best seen in FIG. 4, temperature sensor 34 (as well as sensors 56, 58, 60 and 62) includes sensor probe 106 which is enclosed in a tubular insert 108, preferably made of stainless steel. Insert 108 with probe 106 inside is held by a T-shaped pipe 110 having opposed horizontal threaded ends 112 and 114 and a perpendicular threaded end 116. End 112 is suitably threadedly attached to opening 104. Exiting end 114 is the electrical line connecting temperature sensor 34 to controller 38. Threaded end 116 is suitably configured to reconnect existing mechanical high pressure controls, if any (not shown); thus, permitting continued use of such controls which are customary on typical compressors.

Figure 5:
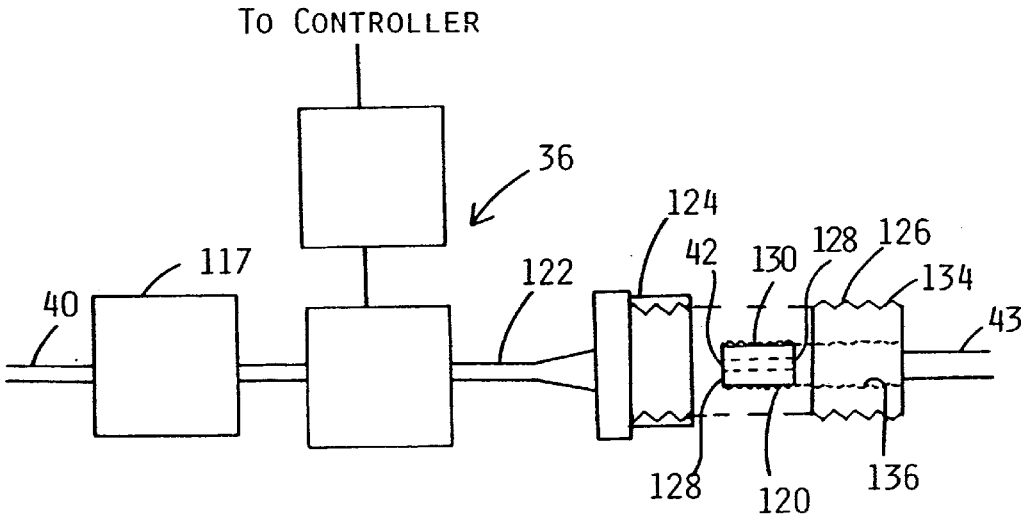
FIG. 5 is a schematic side elevational view of the injection valve in accordance with the present invention.

Referring to FIG. 5, solenoid actuated valve 36 (as well as valves 64, 66, 68 and 70) includes a strainer 117 which is positioned in line 40 to strain or sieve the liquid refrigerant conducted to valve 36. Valve 36 is suitably a mechanical valve having a capacity for a very high number of duty cycles while also assuring leak resistance in the off position. The set temperatures for opening and closing valve 36 can be adjusted to those appropriate to the particular type of compressor and refrigerant. Valve 36 has provided downstream orifice 42 sized to provide a maximum fluid flow therethrough at a pressure differential which corresponds to the evaporator temperature and the condenser temperature so as to assure adequate cooling liquid is provided to compressor 14 to prevent overheating thereof. Evaporator temperature refers to the saturation temperature of the refrigerant as it enters the evaporator and has passed through an expansion valve 119, as seen in FIG. 1. Condenser temperature refers to the saturation temperature of the refrigerant as it leaves the condenser. It should be noted that it is important that orifice 42 be sized to create a pressure drop thereacross which is substantially equal to the pressure drop occurring between the condenser outlet and the compression suction inlet, across the evaporator, so as to prevent subjecting the evaporator to a back pressure which may result in excessive efficiency losses. This pressure drop is different for different capacity compressors.

Orifice 42 of valve 36 is an adjustable orifice. Orifice 42 is provided in the form of a set of fluid injection pills 120 having differing sized orifices or apertures therethrough. As best seen in FIG. 5, valve 36 includes an outlet line 122 having a threaded fitting end 124 and a complementarily threaded fitting 126. Pills 120 are suitably cylindrically shaped, having opposed ends 128, a sidewall 130 and orifice 42 therethrough. Fitting 126 is substantially cylindrically tubular, having an outside threaded sidewall 134 and an inside threaded sidewall 136. Sidewall 130 of pill 120 is suitably threadedly complementary to the threads of inside sidewall 136 of fitting 126. Outside sidewall 134 of fitting 126 is threadedly complementary to fitting end 124. Orifices are conveniently sized to the horsepower of the compressor on which the injection system in accordance with the present invention is installed, e.g., a #4 orifice is typically suitable for a 1–3 horsepower compressor, a #6 for 5–10 horsepower and a #8 for 10–30 horsepower. It is noted, however, that actual operating conditions will dictate orifice size. If the injection system in accordance with the present invention is installed and the valve is injecting but the discharge temperature is not decreasing, a larger orifice should be installed. On the other hand, if flooding occurs into the compressor, a smaller orifice should be installed.

Controller 38 is suitably a four-digit microprocessor-based auto-tune fuzzy and PID universal controller, such as model # E-4524, Cutler-Hammer, Watertown, Wis. The "on/off" temperatures for valve 36 are fully adjustable and can be set to the particular refrigerant/compressor conditions. In a preferred embodiment, the controller is set to a set point valve, e.g., 265° F. The injection "-on" temperature to open the injection valve is 5–7° F. above the setpoint valve of, e.g., 265° F. The injection "-off" temperature to close the injection valve is 5–7° F. below the setpoint. Controller 38 has an auto reset for high temperature cutout conditions, i.e., when the sensed temperature is about 30° F. above the setpoint, an alarm sounds and the compressor is closed off. The alarm turns off at approximately the setpoint and the compressor is automatically turned back on. Controller 38 has a digital display 138 which, in one mode, provides a readout of the discharge temperature sensed by sensor 34.

In operation, upon initial startup from a "cold" condition, valve 36 will be closed as the temperature of compressor 14, as sensed by sensor 34, will be low enough not to require any additional cooling. The refrigeration circuit will function in the normal manner with refrigerant being circulated through condenser 18, receiver 20, evaporator 24, optionally accumulator 28 and compressor 14. As the load upon the refrigeration system increases, the temperature of the discharge gas will increase. When the temperature of the discharge gas exiting the compression chamber 100 of compressor 14, as sensed by sensor 34, reaches a first preselected temperature, controller 38 will actuate valve 36 to an open position, thereby allowing high pressure liquid refrigerant exiting receiver 20 to flow through line 40, valve 36, orifice 42, and line 43 and be injected into suction line 32 via injection port 44.

It should be noted that the liquid refrigerant will normally be partially vaporized as it passes through orifice 42; thus, the fluid entering through port 44 will typically be two phase, i.e., part gas and part liquid. This cool liquid refrigerant will mix with the relatively warm suction gas in suction line 32 and be drawn in compressor 14 where it will vaporize. The vaporization of this liquid refrigerant will cool the suction gas and the compressor itself, thereby resulting in a lowering of the temperature of the discharge gas as sensed by sensor 34.

Once the discharge temperature sensed by sensor 34 drops below a second preselected temperature, controller 38 will operate to close valve 36, thereby shutting off the flow of liquid refrigerant until such time as the temperature of the discharge gas sensed by sensor 34 again reaches the first preselected temperature. Preferably, the first preselected temperature at which valve 36 will be opened will be below the temperature at which any degradation of the compressor operation or life expectancy will occur and in particular, below the temperature at which any degradation of the compressor lubricant or oil occurs. The second preselected temperature will preferably be set sufficiently below the first preselected temperature so as to avoid excessive rapid cycling of valve 36 yet high enough to insure against possible flooding of the compressor. Controller 38 permits the first and second temperatures to be set depending on the particular compressor involved, i.e., the "on/off" temperatures for the valve are completely adjustable to conditions present.

It has been found that injection of refrigerant in the suction line also subcools the compressor oil. Such subcooling is unexpected and particularly advantageous as degradation of the oil is a primary reason for damage to a compressor with discharge temperature problems.

To retrofit an existing refrigeration system, the only structural modifications needed are a tap into suction line 32 to install injection port 44 and a tap into line 26 to provide line 40 to supply liquid refrigerant to valve 36. The mechanical high pressure controls are removed from opening 104 and sensor 34 is threadedly attached to opening 104 while the high pressure controls are refit into end 116 of sensor 34. Injection valve 36 and controller 38 are installed and controller 38 is set to the appropriate "on/off" temperatures for the particular refrigerant to be used. The current refrigerant is removed from the system and the system is charged with the new refrigerant.

Figure 6:
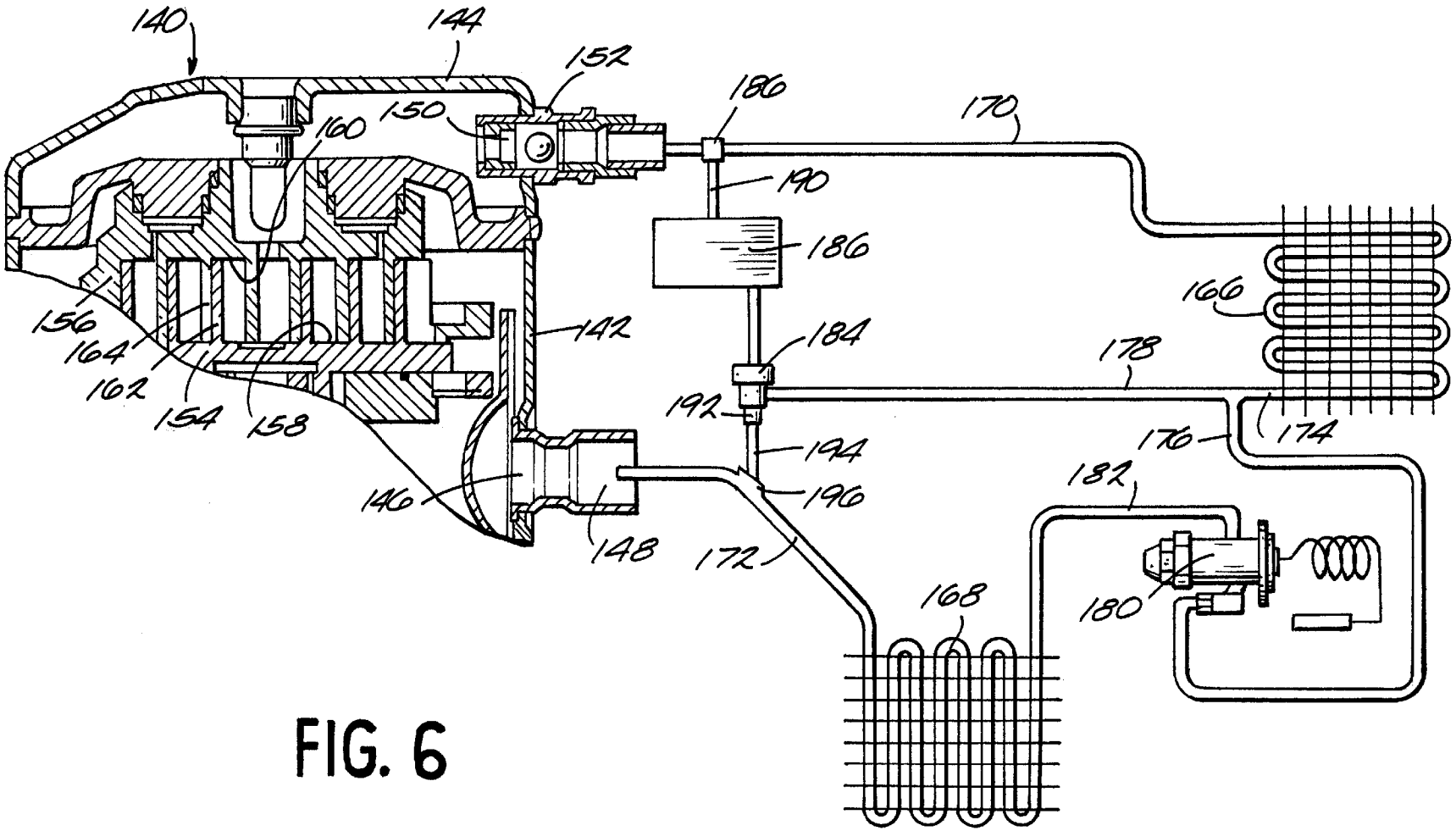
FIG. 6 is a schematic diagram of a system utilizing a scroll type compressor, depicting a fragmentary vertical sectional view of the scroll type compressor and illustrating the incorporation of the cooling liquid injection system in accordance with the present invention.

Reference is now made to FIG. 6 illustrating the incorporation of the liquid injection system of the present invention in a system utilizing a scroll type compressor, generally designated as reference numeral 140. Scroll compressor 140 includes an outer hermetically sealed shell 142 and a cover member 144 closing the upper end of shell 142. A suction inlet port 146 provided with an appropriate inlet fitting 148 is provided in a sidewall portion of shell 142. A discharge port 150 with an appropriate discharge fitting 152 is provided in a portion of cover member 144. Fittings 148 and 152 are secured to respective ports 146 and 150 for connecting the compressor to a refrigeration system. Scroll compressor 140 includes orbiting and non-orbiting scroll members, 154 and 156, respectively. Scroll members 154 and 156 include end plates 158 and 160 from which extend interleaved spiral wraps 162 and 164, respectively, generally defined as the involute of a circle, which operate to define moving fluid pockets of changing volume as scroll member 154 orbits with respect to scroll member 156.

In addition to compressor 140, the system depicted in FIG. 6 includes a condenser 166, an evaporator 168, a compressor discharge line 170, and a compressor suction line 172. Discharge line 170 is connected to discharge fitting 152 for supplying high pressure refrigerant to condenser 166. A liquid line 174 extends from condenser 166 and branches into a normal liquid flow line 176 and a liquid injection line 178. Completing the general operation of the refrigeration system, line 176 communicates condensed relatively high pressure liquid refrigerant to an expansion value 180 where it is expanded into relatively low pressure liquid and vapor. A line 182 communicates the low pressure liquid and vapor to evaporator 168 where the liquid evaporates, thereby absorbing heat and providing the desired cooling effect. Finally, suction line 172 delivers the low pressure refrigerant vapor to the suction inlet of compressor 140. Liquid injection line 178 communicates with an injection valve 184 which is operatively connected to a controller 186, as described hereinbefore. A temperature sensor 186 is optionally positioned within discharge line 170 or adjacent, e.g., affixed to, discharge line 170 and operates to provide a signal to controller 186 which is indicative of the temperature of the compressed gas being discharged from the compressor via a connection line 190. The output from valve 184 is fed into a restricted orifice 192, and then through a line 194 to an injection port 196 provided in suction line 172.

The operation of the cooling liquid injection system in accordance with the present invention is the same for a scroll type compressor as described and explained hereinbefore for a general compressor.

The present invention is further explained by the following examples which should not be construed by way of limiting the scope of the present invention.

EXAMPLE 1

Comparison of AZ50 Refrigerant and R-502 Refrigerant

Operating characteristics of the refrigerant AZ50 were compared with the refrigerant R-502. The refrigeration system used was a single compressor system as, e.g., illustrated in FIG. 1, with one compressor using R-502 and another using AZ50. Both compressors had the exact same size/same model condenser. The outside temperature was 90° F., sitting in the sun. The room temperature was −5° F. Pressure and temperature sensors were installed to sense the discharge temperature and pressure, the suction pressure and temperature, the liquid refrigerant temperature coming out of the receiver, and the temperature of refrigerant going in and coming out of the condenser. The results are given below in Table I.

TABLE 1

| | AZ 50 | R 502 |
|---|---|---|
| Discharge pressure (psig) | 325 | 225 |
| Discharge temperature (deg.) | 176 | 160 |
| Suction pressure (psig) | 26 | 20 |

TABLE 1-continued

| | AZ 50 | R 502 |
|---|---|---|
| Suction temperature (deg.) | 46 | 67 |
| Liquid temp out of receiver (deg.) | 101 | 97 |
| Condensing temperature in (deg.) | 170 | 155 |

TABLE 1-continued

| | AZ 50 | R 502 |
|---|---|---|
| Condensing temperature out (deg.) | 109 | 99 |
| Heat of rejection (deg.) | 61 | 56 |
| Sight Glass | bubbles | clear |
| Current draw (amps) | 12.5 | 11.5 |
| sample reading #2 | 12.3 | 11.3 |
| sample reading #3 | 11.9 | 10.8 |

The results demonstrate clearly the problem when an existing system utilizing the older R-502 refrigerant is converted to the newer AZ50.

EXAMPLE 2

Use of the injection system of the present invention to convert an existing supermarket freezer using R-502 to R-22

A supermarket freezer rack system having four compressors was converted from use of R-502 to R-22. The four compressors were Reed or Discus compressors, Reed models #9RS-0760-TSK (7.5 H.P.), #4RA-1000-TSK (10 H.P.), #4RL-1500-TSK (15 H.P.) and Discus model #4DT-2200-TSK (22 H.P.). Temperature and pressure data were collected by a Robert Shaw computerized control system, model #DMS 350. Suction and discharge pressure sensing were done by a 4–20 MA Setra pressure transducer and were located in the suction and discharge headers. In the R-502 test, the discharge sensing temperature was adjusted to reflect temperature in the compressor head which was found to be 40° F. higher than the discharger header. The temperature sensor was an Automation Components Inc., model #ACI/1000. In the R-22 test, discharge temperature data were directly collected from the discharge chamber of the compressor head by an Automation Components Inc. Model #ACI/1000. Case temperatures were also sensed by the same ACI sensor. Data regarding the operation of the system using the R-502 refrigerant are given in Table II below.

TABLE II

Test Year
R-502Freon Type
Reed or Discus Valve Type of Compressor

| Outside Air Temp Deg F | 1996 Suction (PSIG) | 1996 Dis (PSIG) | Discharge Temp Deg F | Temperature Walk-in Freezer Deg F | Temperature 11 Doors of Frozen Food Deg F | Temperature Walk in Bakery Deg F | Temperature 13 Doors of Frozen Food Deg F | Temperature 7 Doors of Frozen Food Deg F | Temperature Frozen Food Tub Freezer Deg F |
|---|---|---|---|---|---|---|---|---|---|
| 92 | 13 | 190 | 231 | −2 | −5 | 4 | −6 | −14 | −5 |
| 93 | 12 | 201 | 237 | −4 | −9 | −1 | −9 | −17 | −8 |
| 82 | 14 | 200 | 235 | −5 | −5 | 2 | −1 | −14 | −5 |
| 73 | 12 | 192 | 233 | −5 | −9 | −4 | −9 | −16 | −6 |
| 57 | 13 | 194 | 219 | −5 | −9 | 0 | −9 | −15 | −6 |
| 57 | 14 | 180 | 211 | −5 | −8 | 1 | −9 | −13 | −5 |

The system was then retrofit with an injection valve in each suction line to each compressor, a digital controller was installed for each valve as described hereinbefore; the temperature sensor for the discharge chamber was connected to the digital controller. The R-502 refrigerant was removed and the system was charged with R-22. The operating data of the system retrofit with the liquid refrigerant injection system of the present invention are given below in Table III.

TABLE III

| Test Year<br>R-22 Freon Type<br>Reed or Discus Valve Type of Compressor | | | | | | | | | |
|---|---|---|---|---|---|---|---|---|---|
| Outside Air Temp Deg F | 1996 Suction (PSIG) | 1996 Dis (PSIG) | Discharge Temp Deg F | Temperature Walk-in Freezer Deg F | Temperature 11 Doors of Frozen Food Deg F | Temperature Walk in Bakery Deg F | Temperature 13 Doors of Frozen Food Deg F | Temperature 7 Doors of Frozen Food Deg F | Temperature Frozen Food Tub Freezer Deg F |
| 94 | 8 | 194 | 260 to 270 | −4 | −6 | −3 | −9 | −9 | −3 |
| 85 | 9 | 195 | 260 to 270 | −5 | −5 | −3 | −9 | −9 | −1 |
| 80 | 8 | 171 | 260 to 270 | −6 | −6 | −3 | −9 | −8 | 0 |
| 74 | 8 | 184 | 260 to 270 | −7 | −7 | −8 | −10 | −10 | 0 |
| 71 | 7 | 185 | 260 to 270 | −2 | −7 | −6 | −11 | −7 | 0 |
| 65 | 8 | 181 | 260 to 270 | −5 | −5 | −7 | −10 | −8 | −2 |

The results show that the refrigeration system retrofit with the injection system of the present invention held the discharge temperature at a level that permitted the compressors to operate in the safe operation range. At the same time, the case temperatures were equal, and in many instances, better than when the refrigeration system operated with the R-502 refrigerant.

EXAMPLE 3

Use of the injection system of the present invention to convert an existing walk-in freezer using R-502 to R-22

A similar test was performed on a walk-in freezer operating with R-502 refrigerant. The compressor was a semi-hermetic Reed valve unit, model #KAJ1-0100-TAC. Suction and discharge pressures were recorded with mechanical gauges. The discharge temperature was sensed by the ACI sensor of Example 2 and the controller was a Cutler-Hammer controller #4524. The walk-in room temperature was monitored by a mechanical thermometer installed in the walk-in freezer area. Data were collected manually. As in Example 2, system data were first collected using the existing R-502 refrigerant, which was then removed. The injection valve system in accordance with the present invention was installed and the refrigeration system was charged with R-22 refrigerant. Operating data for use of the R-502 refrigerant are given in Table IV below. TABLE IV

TABLE IV

| Test on R-502<br>Type of Compressor: Semi-Hermetic Reed Valve | | | | |
|---|---|---|---|---|
| Shop Air Temp Deg F | Suction (PSIG) | Dis (PSIG) | Discharge Temp Deg F | Temperature Walk-in Freezer Deg F |
| 80 | 15 | 190–230 | 185 | −10 |

Operating data for use of the R-22 refrigerant are given in Table V below.

TABLE V

| Test on R-22<br>Type of Compressor: Semi-Hermetic Reed Valve | | | | |
|---|---|---|---|---|
| Shop Air Temp Deg F | 1997 Suction (PSIG) | 1997 Dis (PSIG) | Discharge Temp Deg F | Temperature Walk-in Freezer Deg F |
| 79 | 10 | 190–230 | 220–210 | −9 |

The results clearly demonstrate that the liquid refrigerant injection system in accordance with the present invention holds the discharge temperature to a range suitable for the compressor to operate safely with the R-22 refrigerant.

In summary, the present invention provides a simple, economical method for retrofitting any make of semi-hermetic or hermetic piston-type or scroll-type compressor that has a high discharge temperature condition resulting from either old type freons or new alternative refrigerants with high discharge temperatures. In other words, the present invention is suitably used to control and limit discharge temperature arising from all variety of reasons.

While the present invention has now been described and exemplified with some specificity, those skilled in the art will appreciate the various modifications, including variations, additions, and omissions, that may be made in what has been described. Accordingly, it is intended that these modifications also be encompassed by the present invention and that the scope of the present invention be limited solely by the broadest interpretation that lawfully can be accorded the appended claims.

What is claimed is:

1. In a refrigeration system including a compressor having a discharge line for discharging gaseous refrigerant and a suction line for admitting gaseous refrigerant, a condenser having a liquid refrigerant outlet and an evaporator, each connected to the compressor and to each other, a liquid refrigerant injection system for controlling discharge gas temperature, comprising:

a temperature sensor operatively associated with the compressor, for sensing the temperature of compressed discharge gaseous refrigerant;

a fluid line connecting the outlet of the condenser to the suction line of the compressor for conducting a liquid refrigerant fluid flow to the compressor;

an injection valve, operatively connected to said fluid line, for injecting liquid refrigerant into the suction line of the compressor, said injection valve including an adjustable orifice through which liquid refrigerant is expanded into the suction line, said adjustable orifice provided by one of a plurality of fluid injection pills, each releasably attached downstream to said valve and each with a different aperture size therethrough; and a controller operatively connected to said sensor, for selectively actuating said valve based on the temperature of the gaseous refrigerant.

2. The refrigeration system of claim 1, wherein said controller actuates said valve to an open position to allow fluid flow into the suction line in response to a sensed temperature above a first preselected temperature and to a closed position to prevent fluid flow through said fluid line in response to a sensed temperature below a second preselected temperature.

3. The refrigeration system of claim 2, wherein said controller includes an adjustable temperature setting means for setting said first predetermined temperature and said second predetermined temperature according to performance parameters of the compressor.

4. The refrigeration system of claim 1, wherein said temperature sensor is disposed with said discharge line.

5. The refrigeration system of claim 1, wherein said temperature sensor is adjacent to the discharge line.

6. The refrigeration system of claim 1, wherein the compressor has a compressor head, a discharge chamber therein within the discharge chamber of the head of the compressor and said temperature sensor is disposed within the discharge chamber.

7. The refrigeration system of claim 1, wherein said injection valve includes a strainer for filtering out any particulates in said fluid line.

8. The refrigeration system of claim 1, further comprising a plurality of compressors each having a temperature sensor disposed in discharge chamber, an injection valve for injecting liquid refrigerant into the suction line and a controller for selectively actuating the valve.

9. The refrigeration system of claim 1, wherein said temperature sensor is dimensioned and configured to reconnect mechanical high pressure safety controls without modification to the compressor.

10. A kit for retrofitting a refrigeration or air conditioning system having a scroll compressor to use a refrigerant with a high gas discharge temperature, comprising:

a temperature sensor for sensing the temperature of the discharge gaseous refrigerant in the discharge line of the scroll compressor;

an injection valve for controlling injection of liquid refrigerant into the suction line of a compressor of the refrigeration system;

a set of fluid injection pills having various orifice sizes therethrough for attaching to said valve; and a controller for selectively actuating said valve.

11. A method of retrofitting a refrigeration or air conditioning system for using a different refrigerant with high gas discharge temperature, the system including a scroll compressor having a discharge line and a suction line, and a condenser, the method comprising the steps of:

removing a current refrigerant from the refrigeration system;

providing a temperature sensor for operative association with the compressor for sensing the temperature of the discharge gaseous refrigerant of the compressor;

providing a fluid line from the condenser for conducting liquid refrigerant to the suction line of the compressor;

attaching an injection valve to the fluid line for controlling liquid refrigerant fluid flow into the suction line;

operatively associating a controller with the injection valve to control the amount of liquid refrigerant injected into the suction line based on the temperature of the discharge gaseous refrigerant of the compressor; and recharging the system with a different refrigerant.

12. The method of claim 11 wherein said different refrigerant is selected from the group consisting of R-22, AZ-50, MP-39, R401A, R401B, R402B, R403B, R406A, R408A, R409A, R404A, R407, R407B, R407C, R410A and R507.

13. In a refrigeration system including a compressor having a discharge line for discharging gaseous refrigerant from the compressor and a suction line for admitting gaseous refrigerant into the compressor, a condenser having a liquid refrigerant outlet and an evaporator, each connected to the compressor and to each other in a closed loop, a liquid refrigerant injection system for controlling discharge gas temperature, comprising:

a temperature sensor, an injection valve, an electronic controller and a liquid refrigerant fluid line connecting the outlet of the condenser to the suction line of the compressor;

said temperature sensor, for sensing and transmitting temperature signals of discharged gaseous refrigerant;

said controller electronically coupled to said temperature sensor for receiving said transmitted temperature signals, for comparing said transmitted temperature signals to a preselected temperature, and for developing valve actuating signals for actuating said injection valve;

said injection valve operatively associated with said controller and communicating with said fluid line, said injection valve responsive to said valve actuating signals, for controlling fluid flow into the suction line, said injection valve including an adjustable orifice through which liquid refrigerant is expanded into the suction line, said adjustable orifice provided by one of a plurality of fluid injection pills, each releasably attached downstream to said valve and each with a different aperture size therethrough.

14. The system of claim 13, wherein said transmitted temperature signals are less than said first temperature, and said controller develops a valve actuating signal corresponding to closing of said injection valve.

15. The system of claim 13 wherein the compressor has a compressor head and a discharge chamber therein and said temperature sensor is disposed in the discharge chamber.

16. The system of claim 13 wherein said temperature sensor is disposed in the discharge line.

17. The system of claim 13, wherein said preselected temperature includes a first temperature and a second temperature, said second temperature being greater than said first temperature.

18. The system of claim 13, wherein said transmitted temperature signals are greater than said second temperature, and said controller develops a valve actuating signal corresponding to opening of said injection valve.

* * * * *